US006926104B2

(12) United States Patent
Mocivnik et al.

(10) Patent No.: US 6,926,104 B2
(45) Date of Patent: Aug. 9, 2005

(54) DRILL CROWN

(75) Inventors: Josef Mocivnik, Fohnsdorf (AT); Romain Clesen, Colpach-Haut (LU); Guy Thillen, Diekirch (LU)

(73) Assignee: Techmo Entwicklungs- und Vertriebs GmbH, Fohnsdorf (AT)

( * ) Notice: Subject to any disclaimer, the term of this patent is extended or adjusted under 35 U.S.C. 154(b) by 0 days.

(21) Appl. No.: 10/766,214

(22) Filed: Jan. 29, 2004

(65) Prior Publication Data

US 2004/0182610 A1 Sep. 23, 2004

Related U.S. Application Data

(63) Continuation of application No. PCT/AT02/00227, filed on Jul. 31, 2002.

(30) Foreign Application Priority Data

Aug. 1, 2001 (AT) ..... A 1201/2001

(51) Int. Cl.[7] ..... E21B 10/36
(52) U.S. Cl. ..... 175/414; 175/435
(58) Field of Search ..... 175/414, 415, 175/420, 420.1, 426, 435

(56) References Cited

U.S. PATENT DOCUMENTS

| | | | | | |
|---|---|---|---|---|---|
| 3,548,959 | A | * | 12/1970 | Hasiba | 175/393 |
| 3,693,736 | A | * | 9/1972 | Gardner | 175/426 |
| 4,014,395 | A | * | 3/1977 | Pearson | 175/426 |
| 4,047,583 | A | * | 9/1977 | Dyer | 175/426 |
| 4,660,660 | A | * | 4/1987 | Yuh | 175/426 |
| 4,951,672 | A | | 8/1990 | Buchwald et al. | 128/653 |
| 5,558,170 | A | | 9/1996 | Thigpen et al. | 175/57 |
| 5,947,215 | A | * | 9/1999 | Lundell | 175/417 |
| 6,494,275 | B2 | * | 12/2002 | Asberg et al. | 175/401 |
| 6,508,318 | B1 | * | 1/2003 | Linden et al. | 175/414 |
| 6,655,480 | B1 | * | 12/2003 | Boyd | 175/420.1 |
| 2001/0047890 | A1 | * | 12/2001 | Meyers et al. | 175/420.1 |

FOREIGN PATENT DOCUMENTS

| | | |
|---|---|---|
| DE | 3408225 | 9/1985 |
| EP | 0353214 | 1/1990 |
| EP | 0573135 | 12/1993 |
| EP | 0581534 | 2/1994 |
| EP | 0943780 | 9/1999 |
| FR | 2343885 | 10/1977 |

* cited by examiner

*Primary Examiner*—David Bagnell
*Assistant Examiner*—Daniel P Stephenson
(74) *Attorney, Agent, or Firm*—Jacobson Holman PLLC

(57) ABSTRACT

A drill crown (1) used for drilling purposes, especially for rotary percussion drilling of a mouth of a blast furnace. The drill crown (1) consists of a drilling head (4) provided with a plurality of hard material or hard metal inserts (6) and a base body (2) for connection to a drive element etc. in order to drive or impinge upon said drill crown. The hard material or hard metal inserts (6) are received in bores or openings (5) of the drill head (4). According to the invention, at least one hard material or hard metal insert (6) is provided with an at least partially curved or domed surface contour (11) on the end which is received in the drill head (4). Said contour cooperates with a complementary domed or curved surface of the drill head (4) and/or base body (2), whereby the percussive energy required for appropriate drilling power is transmitted in a reliable manner, even when the hard material or hard metal insert (6) is slackened.

8 Claims, 2 Drawing Sheets

DRILL CROWN

This is a continuation application of PCT/AT02/00227, filed on Jul. 31, 2002.

BACKGROUND OF THE INVENTION

The present invention relates to a drill bit for drilling and, in particular, rotary percussion drilling a hole and, in particular, a tap hole of a blast furnace, wherein the drill bit is comprised of a drill head including a plurality of hard-material or hard-metal inserts and a base body to be connected with a driving element or the like for actuating or powering the drill bit, said hard-material or hard-metal inserts being received in bores or openings of the drill head, wherein at least one hard-material or hard-metal insert, on its end received within the drill head, is at least partially designed with a curved or cambered surface contour that cooperates with a complementary, cambered or curved surface of the drill head and/or the base body.

In the context of drill bits or crowns it is known in order to increase the drilling performance, to fix a plurality of hard-material or hard-metal inserts in a head, whereby such fixing can, for instance, be realized by using sleeve-shaped inserts as can be taken, for instance, from EP-B 0 581 534, U.S. Pat. No. 4,951,672, EP-A 0 573 135, EP-A 0 943 780 or EP-A 0 353 214. Moreover, it is known to solder such hard-material or hard-metal inserts to, for instance, the base material of a drill head in order to avoid falling out of said hard-material inserts as can be taken, for instance, from DE-A 34 08 225. Known hard-material or hard-metal inserts in the context of the production of a drill bit usually comprise, on the cutting part projecting out of the drill head, a plane extending substantially normal to the longitudinal axis of the insert and possibly resting on an accordingly plane surface of the base material for the purpose of force transmission, while, according to DE-A 34 08 225, a recess is provided below the ends of the inserts such that no direct contact is provided between the insert and the bore. Bearing in mind the rough operating conditions and the forces to be applied particularly in rotary percussion drilling, and due to the usually not completely uniform load exerted on the drill bit and, in particular, the hard-material or hard-metal inserts, which are partially arranged at an angle relative to the longitudinal axis of the drill bit so as to cover an appropriate drilling surface, eccentric or nonuniform stresses occur on the hard-material inserts such that no proper force transmission from the drill head or base material to the hard-material or hard-metal inserts will be readily ensured, in particular with a progressive operating time on account of wear.

An embodiment of the type mentioned above can for example be taken from U.S. Pat. No. 5,558,170, wherein receiving openings for the hard-material or hard-metal inserts have to be formed with a special tool.

The present invention aims to ensure, with hard-material or hard-metal inserts being provided or arranged on the drill head of a drill bit, that even in the event of a nonuniform stress or wear of such hard-material or hard-metal inserts an accordingly large area or large and substantially constant surface region will be provided for the transmission of the impact energy required to obtain an accordingly rapid drilling progress and to prevent that an insert being potentially loosened falls out.

SUMMARY OF THE INVENTION

To solve these objects, the drill bit according to the invention, departing from a drill bit of the initially defined kind, is essentially characterized in that the end of the hard-material or hard-metal insert, which is designed with said cambered or curved surface contour has external dimensions larger than those of the end of the hard-material or hard-metal insert projecting out of the drill head. Thereby it can be prevented that a hard-material or hard-metal insert falls out of the drill head or base body already upon slight loosening of the same. On account of such enlarged external dimensions being proposed according to the invention, the hard-material insert can be safely mounted in the respective reception opening of the drill bit, and it is, furthermore, feasible to provide an accordingly large surface area for the safe transmission of impact energy.

By designing at least one hard-material or hard-metal insert on its end received within the drill head, at least partially with a curved or cambered surface contour that cooperates with a complementary, cambered or curved surface of the drill head and/or the base body, it is safeguarded that even in the event of a nonuniform stress or wear of such a hard-material or hard-metal insert and an optionally resulting loosening of the same in the reception opening within the drill head, all of the separation energy and, in particular, impact energy will nevertheless be reliably introduced or transmitted into the material to be worked, from the base body of the drill bit via the respective hard-material insert or all hard-material inserts. The arrangement of accordingly curved or cambered surface contours both on the end received within the drill head, of the respective hard-material insert and on the drill head and base body surfaces cooperating therewith results in a large and substantially constant surface for the transmission of the impact energy applied on the base body of the drill bit through a drill rod assembly and an impact element acting thereon.

According to a particularly preferred embodiment, it is proposed that the cambered surface contour of the end of the hard-material or hard-metal insert is formed by a spherical surface or spherical layer, such a spherical surface or spherical layer rendering feasible a cost-effective and simple manufacture enabling as large an adjustability as possible of the positioning of an eventually loosened hard-material insert within the drill head or the respective reception opening, respectively.

In order to enable the proper and simple fixation of a hard-material or hard-metal insert, it is proposed according to a further preferred embodiment that the clear width of a bore or opening intended to receive the hard-material or hard-metal insert at least slightly exceeds the external dimensions of the hard-material or hard-metal insert end to be received within the drill head, and that the hard-material or hard-metal insert in its partial region received within the bore is surrounded by a sleeve whose external dimensions are adapted to the clear width of the bore of the drill head, wherein, as mentioned in the beginning, the use of appropriate sleeves for the fixation of hard-material or hard-metal inserts is known per se.

In order to ensure the safe fixation of such a hard-material or hard-metal insert by using a sleeve, it is proposed according to another preferred embodiment that the sleeve surrounding the hard-material or hard-metal insert is weldable with the material of the drill head. While hard-material or hard-metal inserts in known embodiments were usually soldered directly to the material of the drill head or the base body, the use of a sleeve allows for the realization of a weld between the sleeve material and the material of the base body or drill head, welding of the materials used for the hard-material or hard-metal inserts usually being impossible. By providing a weld in order to fix a hard-material or hard-metal insert to the drill head or the base body, it is, furthermore, safeguarded that the welding connection aimed to fix the hard-material or hard-metal insert to the drill bit will not be detached or loosened during the use of a drill bit according to the invention under elevated temperatures applied, for instance, in the production of a tap hole at a blast furnace, despite the high temperatures optionally prevailing.

Alternatively to providing insert sleeves which enable the fixation of hard-material or hard-metal inserts in openings having accordingly enlarged dimensions, it is proposed according to a further preferred embodiment that the hard-material or hard-metal inserts are capable of being fitted into the bores or passage openings from the drill head side facing the base body of the drill bit, and that the drill head is capable of being connected and, in particular, welded with the base body upon reception of the hard-material or hard-metal inserts. After having fitted the hard-material or hard-metal inserts within the drill head with the hard-material inserts being, for instance, secured against falling out by the provision of partial regions having accordingly enlarged external dimensions, the drill head can subsequently be connected and, in particular, welded directly with the base body of the drill bit so as to again ensure a reliable fixation of the hard-material or hard-metal inserts.

Since a substantially hood- or cap-shaped drill head surrounding the base body of the drill bit optionally involves elevated manufacturing expenses, it is proposed according to a further preferred embodiment that the drill head is dividedly designed, particularly on places or lines each intended to receive a plurality of hard-material or hard-metal inserts, and that the partial regions of the drill head upon reception of the hard-material or hard-metal inserts within the bores or openings are capable of being connected and, in particular, welded with one another and/or with the base body. Such partial regions or partial sections of the drill head also can be produced to mutually mate in an accordingly simple and precise manner, whereupon the individual elements of the drill head likewise are subsequently connected and, in particular, welded with the base body upon reception of the hard-material or hard-metal inserts.

In order to further increase the safety of the fixation of the hard-material or hard-metal inserts within the respective reception openings of the drill bit, it is proposed according to a further preferred embodiment that the bores or openings of the drill head have cross sections tapering towards the outer surface of the drill head and/or are designed to be offset or have widening cross sections in the end regions facing away from the outer surface of the drill head. Such tapering reception openings can be produced in an accordingly simple manner, it being also readily feasible to produce accordingly offset regions that can be adapted, for instance, to widening external dimensions of the hard-material or hard-metal inserts.

BRIEF DESCRIPTION OF THE DRAWINGS

In the following, the invention will be explained in more detail by way of exemplary embodiments schematically illustrated in the accompanying drawing. Therein.

DETAILED DESCRIPTION OF THE PREFERRED EMBODIMENTS

Figure 1:
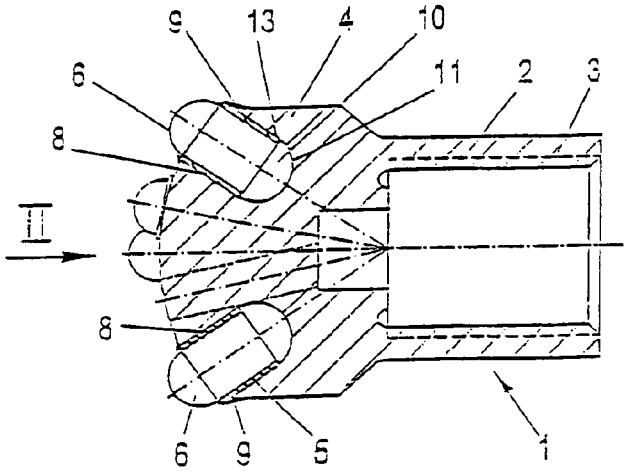
FIG. 1 is a section through a first embodiment of a drill bit according to the invention.
Figure 2:
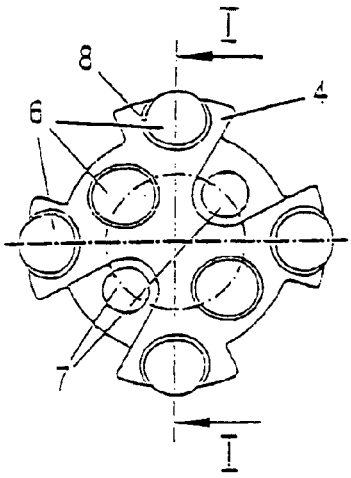
FIG. 2 is a top view on the drill bit depicted in FIG. 1, according to arrow II, with FIG. 1 illustrating a section along line I—I of FIG. 2.

In FIGS. 1 and 2, a drill bit is generally denoted by 1, wherein a base body 2, to which a drill rod assembly not illustrated in detail is, for instance, connected via a schematically indicated screw connection 3, is designed in one piece with a drill head 4. The drill head 4 comprises a plurality of reception openings 5 in which hard-material or hard-metal inserts 6 are each arranged.

Furthermore, it is apparent from the top view according to FIG. 2 that, for instance, two scavenging bores 7 open in the drill head to introduce a scavenging fluid into the region of the working or drilling surface, such a scavenging fluid likewise being introduced through the drill rod assembly not illustrated in detail.

In the embodiment illustrated in FIGS. 1 and 2, the fixation of the hard-material or hard-metal inserts 6 is realized using sleeves 8 which surround the hard-material or hard-metal inserts 6 over partial regions of their longitudinal extensions, said sleeves 8 being welded with the material of the drill head 4 via schematically indicated weld joints or weld seams 9.

Each hard-material or hard-metal insert 6, on its end facing away from the end projecting out of the drill head and received within the drill head 4, comprises a region 10 having, for instance, a spherically shaped surface 11. The reception opening 5 is likewise designed with an accordingly cambered or curved, complementary surface.

By providing both the hard-material or hard-metal insert 6 and the reception opening 5 with mutually mating cambered or curved surface contours 11, it will be safeguarded that an adequate transmission of force from the base body 2 or drill head 4 onto the hard-material or hard-metal inserts 6 can be reliably effected even at a slightly slanted position within the respective reception opening 5, particularly in the event of progressive stresses exerted on the hard-material or hard-metal inserts 6 and likely to cause, for instance, loosening within the individual reception openings 5.

The hard-material or hard-metal inserts 6 in this case each comprise an offset zone 13 in the end region 10, with the end region 10 having enlarged external dimensions relative to the hard-material or hard-metal insert end projecting out of the drill head 4, so that each hard-material or hard-metal insert will be safely retained within the drill head 4 by means of the sleeve 8. Since the sleeve 8 is usually made of a material that is softer or less firm than that of the hard-material or hard-metal insert 6, loosening of the hard-material or hard-metal inserts 6 may be expected especially upon the action of eccentric stresses on the same, whereby it is, however, feasible to prevent the hard-material insert 6 from falling out of the reception opening 5 due to the offset zone or shoulder 13.

It was, furthermore, found that, upon loosening of the hard-material or hard-metal inserts 6 within the reception bores or openings 5 due to the combined as well as alternating impact and torsional stresses occurring during rotary percussion drilling, also rotational movements of the hard-material or hard-metal inserts 6 about their longitudinal axes will take place in the respective reception bores 5, thus inducing a self-sharpening effect of the tips or end regions projecting out of the drill head 4, of the hard-material inserts 6.

Figure 3:
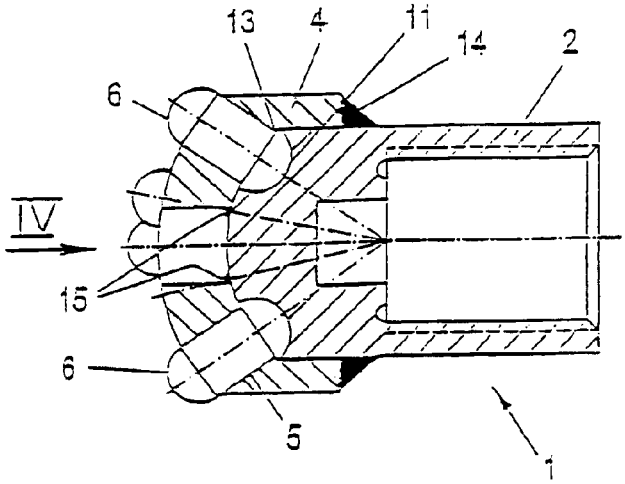
FIG. 3 in an illustration similar to that of FIG. 1 shows a section through a modified embodiment of a drill bit according to the invention.
Figure 4:
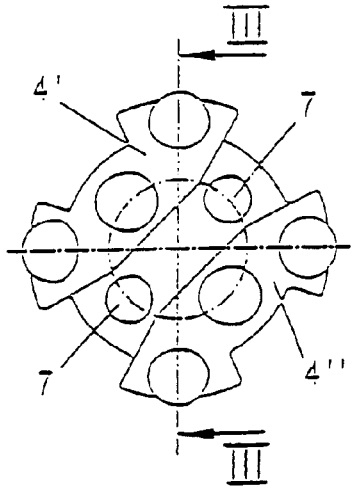
FIG. 4 is a top view on the drill bit depicted in FIG. 3, according to arrow IV, with FIG. 3 illustrating a section along line III—III of FIG. 4.

In the modified embodiment illustrated in FIGS. 3 and 4, the base body, which is again denoted by 2, is designed to be separate from the drill head 4 and, in addition, the drill head 4 is subdivided into two halves, which are denoted by 4' and 4", in particular in FIG. 4.

Instead of using sleeves for the fixation of the hard-material inserts 6 within the drill head 4, the hard-material inserts 6 are introduced into the respective reception openings 5 by insertion from the rear side, or side facing the base body 2, of the drill head 4 prior to fixing the drill head 4 to the base body 2, whereupon the partial regions 4' and 4" of the drill head are subsequently welded with the base body 2, the respective weld being indicated at 14 and 15 in FIG. 3.

As in the embodiment according to FIGS. 1 and 2, both the hard-material or hard-metal inserts 6 and the reception openings 5 each comprise complementary, cambered or curved surfaces 11. Moreover, an offset zone or shoulder 13 is again provided on the end received within the drill head 4, of each hard-material or hard-metal insert 6 as a securing means against falling out from the respective reception opening 5 of the drill head 4.

Figure 5:
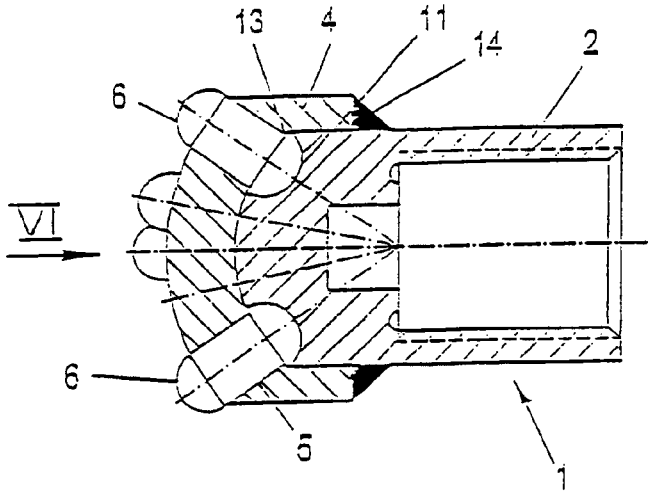
FIG. 5 in an illustration again similar to that of FIG. 1 shows a section through a further modified embodiment of a drill bit according to the invention.
Figure 6:
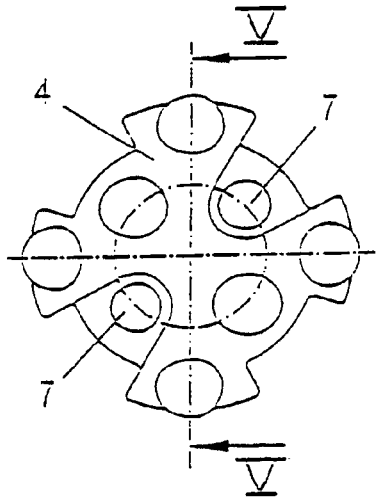
FIG. 6 is a top view on the drill bit depicted in FIG. 5, according to arrow VI, with FIG. 5 illustrating a section along line V—V of FIG. 6.

A drill head 4 which is separated from the base body 2 of the drill bit 1 and in which hard-material inserts 6 are again received in respective reception openings 5 prior to connecting the base body 2 with the drill head 4 is also used in the illustration represented in FIGS. 5 and 6.

As opposed to the embodiment according to FIGS. 3 and 4, the drill head 4 in the embodiment illustrated in FIGS. 5 and 6 is designed in one piece, and the connection with the base body 2 is realized by weld again indicated at 14.

In order to ensure a proper force transmission even upon loosening or wearing of the hard-material or hard-metal inserts 6, both the end received within the drill head 4, of the hard-material or hard-metal insert 6 and the reception zone in the base body 2 are designed with cambered or curved surfaces also in this embodiment.

Instead of configuring all of the hard-material inserts 6 with cambered or curved surfaces, it is also feasible, as a function of the envisaged use, to configure only some of the hard-material inserts 6 in such a manner, for instance only those which are particularly exposed to stress, in order to enable the reliable introduction of the necessary separation energy into the drill hole.

What is claimed is:

1. A drill bit for rotary percussion drilling a tap hole of a blast furnace, wherein the drill bit is comprised of a drill head including a plurality of hard-material or hard-metal inserts and a base body to be connected with a driving element for actuating or powering the drill bit, said hard-material or hard-metal inserts being received in bores or openings of the drill head, wherein at least one hard-material or hard-metal insert, on its end received within the drill head, is at least partially designed with a curved or cambered surface contour that cooperates with a complementary, cambered or curved surface of the drill head and/or the base body, wherein the end of the hard-material or hard-metal insert, which is designed with said cambered or curved surface contour has external dimensions larger than those of the end of the hard-material or hard-metal insert projecting out of the drill head, and wherein the hard-material or hard-metal inserts are capable of being fitted into the bores or passage openings from the drill head side facing the base body of the drill bit, and that the drill head is capable of being connected with the base body upon reception of the hard-material or hard-metal inserts.

2. The drill bit according to claim 1, wherein the cambered surface contour of the end of the hard-material or hard-metal insert is formed by a spherical surface or spherical layer.

3. The drill bit according to claim 1, wherein the clear width of a bore or opening intended to receive the hard-material or hard-metal insert at least slightly exceeds the external dimensions of the end of the hard-material or hard-metal insert, to be received within the drill head, and that the hard-material or hard-metal insert in its partial region received within the bore is surrounded by a sleeve whose external dimensions are adapted to the clear width of the bore of the drill head.

4. The drill bit according to claim 3, wherein the sleeve surrounding the hard-material or hard-metal insert is weldable with the material of the drill head.

5. The drill bit according to claim 1, wherein the drill head is dividedly designed on places or lines intended to each receive a plurality of hard-material or hard-metal inserts, and that the partial regions of the drill head upon reception of the hard-material or hard-metal inserts within the bores or openings are capable of being connected with one another and/or with the base body.

6. The drill bit according to claim 5, wherein that the partial regions of the drill head upon reception of the hard-material or hard-metal inserts within the bores or openings are capable of being welded with one another and/or with the base body.

7. The drill bit according to claim 1, wherein the bores or openings of the drill head have cross sections tapering towards the outer surface of the drill head and/or are designed to be offset or have widening cross sections in the end regions facing away from the outer surface of the drill head.

8. The drill bit according to claim 1, wherein the drill head is capable of being welded with the base body upon reception of the hard-material or hard-metal insets.

* * * * *